United States Patent [19]

Schuck et al.

[11] 4,038,828

[45] Aug. 2, 1977

[54] VERTICAL LIFT AND CONTROL FOR PLOWS

[75] Inventors: Paul R. Schuck, Daven Port; John M. Baylor, Bettendorf, both of Iowa

[73] Assignee: J. I. Case Company, Racine, Wis.

[21] Appl. No.: 648,426

[22] Filed: Jan. 12, 1976

[51] Int. Cl.[2] ..... B63B 35/04; E02F 5/02

[52] U.S. Cl. ..... 61/72.6; 37/193

[58] Field of Search ..... 61/72.6; 37/193, 98; 172/699, 700

[56] References Cited

U.S. PATENT DOCUMENTS

| | | | |
|---|---|---|---|
| 3,395,545 | 8/1968 | Mendaloff, Jr. | 61/72.6 |
| 3,571,956 | 3/1971 | Heiberg | 37/193 |
| 3,657,831 | 4/1972 | Kant | 37/193 |
| 3,684,030 | 8/1972 | Lucero | 172/700 |
| 3,727,696 | 4/1973 | Hansen | 172/40 |
| 3,777,500 | 12/1973 | Kelley | 37/193 |

*Primary Examiner*—Paul R. Gilliam
*Assistant Examiner*—Alex Grosz
*Attorney, Agent, or Firm*—Cullen, Settle, Sloman & Cantor

[57] ABSTRACT

A vertical lift and tilt control for plows which is particularly suitable for laying cable, pipe and the like underground. The vertical lift mechanism includes a mast assembly having a generally vertical rail and a slide frame slideably mounted on the rail. The plow assembly is supported on the slide frame and a power means, such as a piston, is connected to the mast and slide frames for raising and lowering the plow assembly. The mast assembly is pivotally supported on a suitable vehicle and a second power means, such as a piston, is pivotally connected to the vehicle and the mast assembly for adjusting the tilt or attack angle of the plow blade.

5 Claims, 10 Drawing Figures

FIG. 10
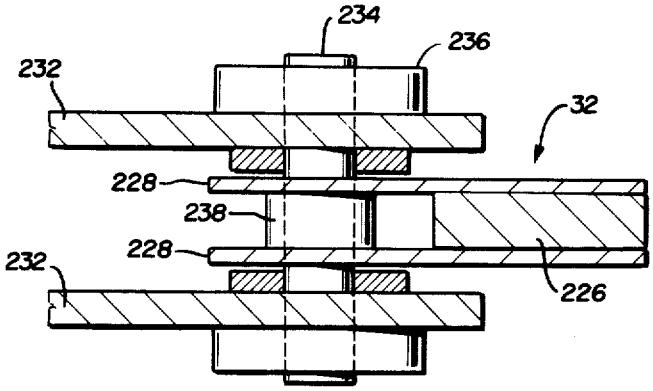
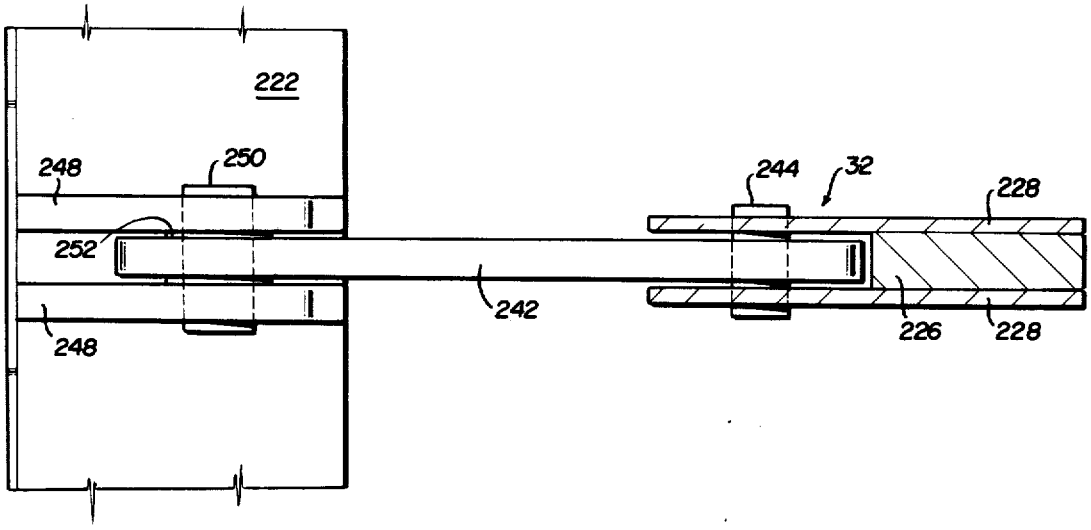
FIG. 9

VERTICAL LIFT AND CONTROL FOR PLOWS

FIELD OF THE INVENTION

The disclosed inventions relates generally to a lift and control mechanism for plows. The lift and control mechanism of this invention is particularly useful in cable laying plows which lay a continuous length of cable, flexible pipe or the like underground at the desired depth.

DESCRIPTION OF THE PRIOR ART

Plows of the type disclosed herein having an elongated vertical blade have been used for several years to lay cable, flexible pipe and the like underground. The cable or pipe may be either pulled through the cut of the plow blade or a cable guide chute may be provided on the trailing edge of the blade which guides the cable into the ground from a drum mounted on the prime mover or vehicle. More recently, various types of vibrators or shakers have been mounted on the plow blade or the supporting frame which effectively reduces the drawbar pull or force required to pull the blade through the ground, such as disclosed in U.S. Pat. No. 3,363,423. Prior to the development of cable laying plows, cable, flexible pipe and the like was layed in a trench dug by a powered trench digging bulldozer or the like. The trench was first dug to the desired depth, the cable was laid in the trench and the trench was filled and compacted. Although cable laying plows have been commercially successful for several reasons, including speed of application, reduced labor costs and damage to the site, the cable may be damaged in certain applications using a vibratory plow, particularly certain sensative electrical cables utilized for communication, including telephone lines.

In a conventional cable laying plow, the blade is rigidly supported generally in the longitudinal axis of the prime mover or vehicle. The attack angle of the blade can not therefore be adjusted and the cable may be damaged because of reverse bending of the cable, particularly during lowering and lifting of the blade. Further, there is a tendancy for additional cable to be drawn through the chute as the plow is raised which may result in cable damage. Finally, in many commerical cable laying plows, the entire plow assembly can not be raised for easy transport.

The vertical lift and tilt control of the cable laying plow of this invention permits remote control of the blade tilt angle and the vertical position of the plow assembly, reducing damage to the cable and permitting easy transport of the plow assembly.

SUMMARY OF THE INVENTION

The plow of this invention includes a prime mover or vehicle and a generally vertically extending plow blade. As described, the elongated vertical plow of this invention is particularly suitable for laying cable or flexible pipe underground. The prime mover may be a conventional bulldozer or tractor and the plow blade may be supported on a suitable support or frame. Where the vertical lift and control of this invention is utilized in a vibratory plow, the plow blade may be supported on a frame assembly which isolates the vibration from the prime mover, such as disclosed in U.S. Pat. No. 3,618,237, which patent is incorporated herein by a reference.

The vertical lift and control assembly of this invention includes a generally vertically extending mast assembly which is preferably pivotally connected and supported on the prime mover or vehicle. The dislosed embodiment of the mast assembly includes a generally vertical frame and one or more vertically extending rails. A slide frame is slideably mounted on the vertical rail and thereby supported on the slide frame and a motor means, such a conventional piston, is connected to the frame of the mast assembly and the slide frame to raise and lower the plow blade. A further power means, such as a piston, is pivotally connected to the vehicle and the mast frame assembly, spaced from the pivotal connection of the mast assembly to the prime mover, to adjust the tilt angle of the mast assembly and therefore the plow blade relative to vertical. The tilt angle and vertical position of the plow blade may therefore be remotely controlled from the vehicle utilizing the vertical lift and control of this invention.

The disclosed embodiment of the mast assembly includes a generally rectangular frame having a pair of laterally spaced generally vertical cylindrical rails and the slide frame includes two laterally spaced plates slideably attached to the slide rals at four positions. The plates include four bushings which conform to the shape of the slide rails, permitting free vertical motion of the slide frames.

Further, as described above, the mast assembly can be tilted or canted by remote control from true vertical. This feature results in several advantages. For example, the plow blade may be tilted to produce additional down pressure at the rear plow. The lift cylinder can also be utilized in this manner. Forward tilt of the mass assembly, toward the prime mover, provides additional lift at the rear of the blade to provide ground clearance during transport. Rearward tilt of the mast causes the plow blade to travel rearwardly when the plow is raised through the use of the vertical lift mechanism. This motion reduces the tendancy for additional cable to be drawn through the chute or cable guide as the plow is raised, thereby reducing cable damage. This action will also reduce cable damage due to reverse bending. Forward tilting of the vertical mast may also be utilized during lowering of the plow blade to protect the cable chute or guide from damage during entry of the blade into the ground. The lower portion of the chute may be tilted up and away from the ground surface during entry of the blade. Other important advantages of the lift control and mechanism of this invention the ability to adjust the attack angle of the plow blade to compensate for varying the soil conditions and the ability to remotely vary the depth of the blade cut without physical rpositioning of the blade with respect to the plow assembly.

Other advantages and meritorious features of the present invention will be more fully understood from the following description of the preferred embodiments, the appended claims and the drawings, a brief description of which follows.

BRIEF DESCRIPTION OF THE DRAWINGS

FIG. 9 is partial cross-sectional bottom view of the linkage shown in FIG. 8, in the direction of view arrows 9—9; and FIG. 10 is a top partially cross-sectioned view of the connection between the plow blade and the frame assembly shown in FIG. 8, in the direction of view arrows 10—10.

DESCRIPTION OF THE DRAWINGS AND PREFERRED EMBODIMENTS

Figure 1:
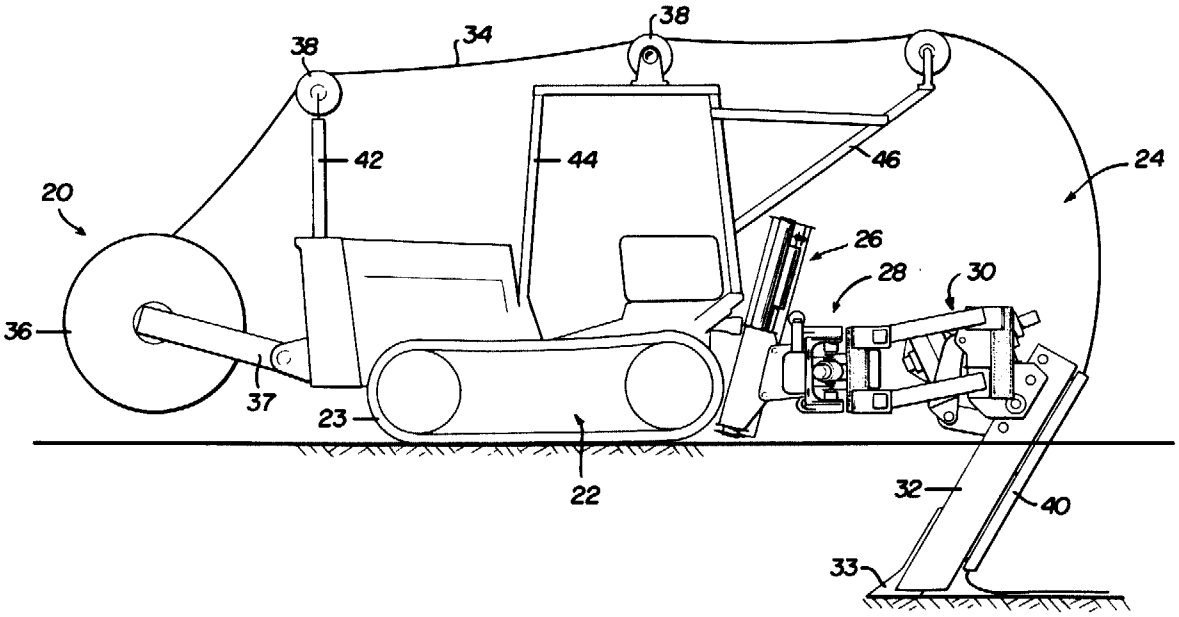
FIG. 1 is a side elevation of one embodiment of a vibratory cable laying plow which includes the present invention.

The embodiment of the cable-laying plow shown in FIG. 1 generally includes a prime mover 22 and a vibratory plow assembly 24. It will be understood that the prime mover may be any suitable vehicle, including bulldozers, tractors and the like. The disclosed embodiment of the prime mover is a conventional bulldizer having a continuous track 23. Generally, the vibratory plow assembly includes a mast assembly 26, an adjustment mechanism 28, a blade support or frame 30 and an elongated blade 32. As described, the mast assembly 26 is adapted to raise, lower and adjust the tilt or cant angle of the blade 32 relative to true vertical. The control mechanism 28 is adapted to adjust the lateral position and angle of the blade 32 relative to the longitudinal axis of the prime mover 22 and the blade support or frame 30 is adapted to vibrate the bulldozer blade and transmit an arcuate or orbital motion to the blade tip or toe 33. As described above, the cable-laying plow of this invention may be utilized to lay cable, flexible pipe or hose underground. It will be understood that the term cable is used herein as a generic term. In the disclosed embodiment of the cable-laying plow, the cable 34 is received from a drum 36 rotatably supported on a suitable boom 38 of the prime mover 22. The cable is then received on reels 38, over the prime mover and the cable is then fed through a guide or cable chute 40 into the cut made by the plow blade 32. The reels 38 in the disclosed embodiment are supported on a forward mast 42, the bulldozer canopy 44 and a rearward mast assembly 46. The mast assembly 26, control 28 and blade support or frame 30 will now be described in detail.

Figure 2:
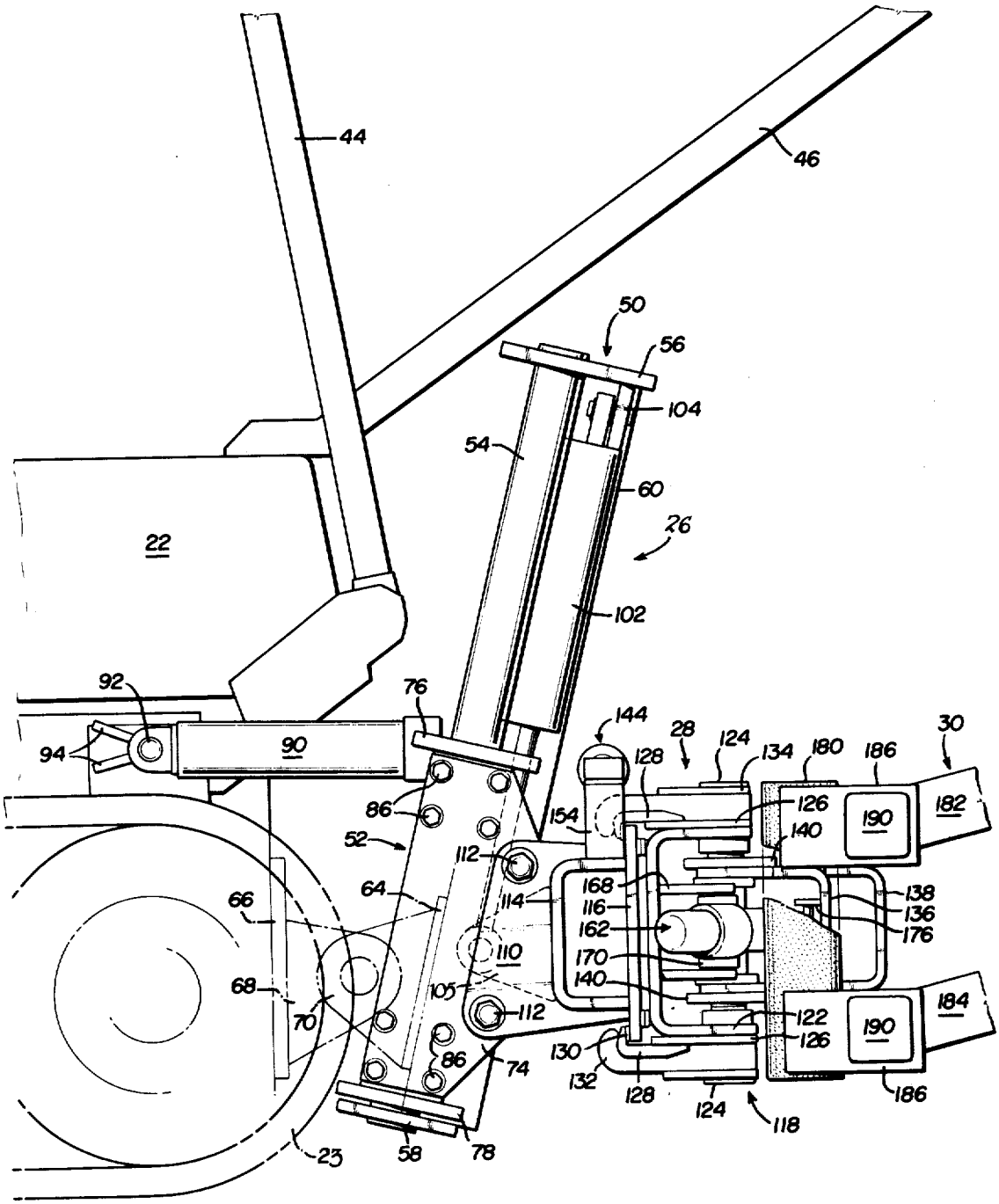
FIG. 2 is an enlarged sided elevation of the mast assembly and control shown in FIG. 1.
Figure 3:
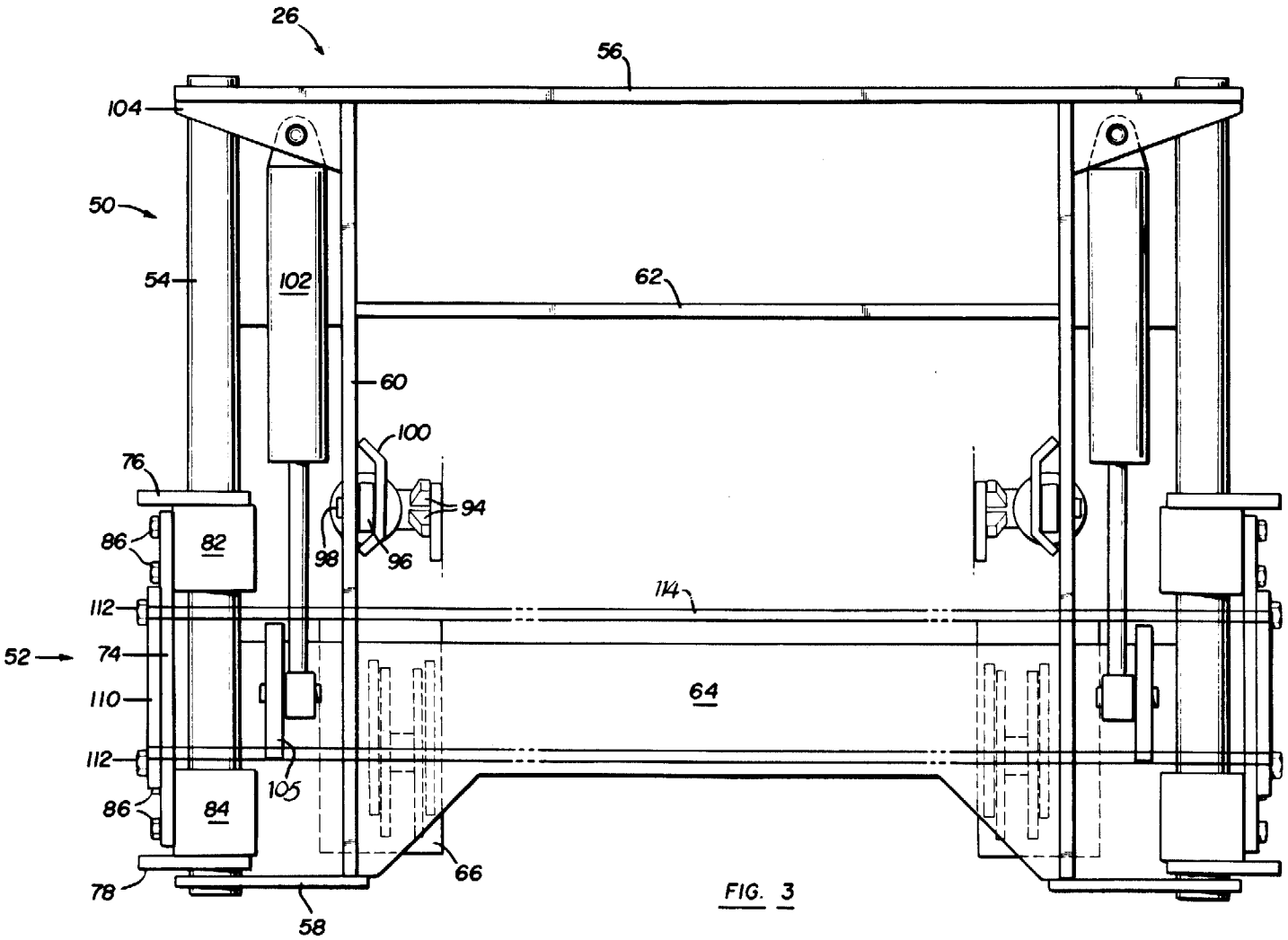
FIG. 3 is a rear elevation of the mast assembly shown in FIGS. 1 and 2.

The mast assembly 26 is shown in detail principally in FIGS. 2 and 3. As shown, the mast assembly 26 generally includes a support frame 50 and a slide frame 52. The support frame includes a pair of generally vertical, laterally spaced, cylindrical rails 54, top and botton plates 56 and 58, respectively, which secure the rails 54, side plates 60, reinforcing horizontal plate 62 and a support plate 64. As will be noted, the support and slide frames are formed of a plurality of vertical and horizontal plates, which are preferably steel plates welded together to form a solid supporting structure for the blade. The support frame is pivotally mounted on the prime mover as shown in FIG. 2. The bulldozer includes a plate 66 secured to the bulldozer frame between the tracks 23. A lug 68 is secured to the plate 66 and a mating lug 70 is secured to the support plate 64 of the support frame 50. A suitable bearing or pin is provided between the lugs 68 and 70 to pivotally support the support frame on the prime mover.

Figures 4, 5:
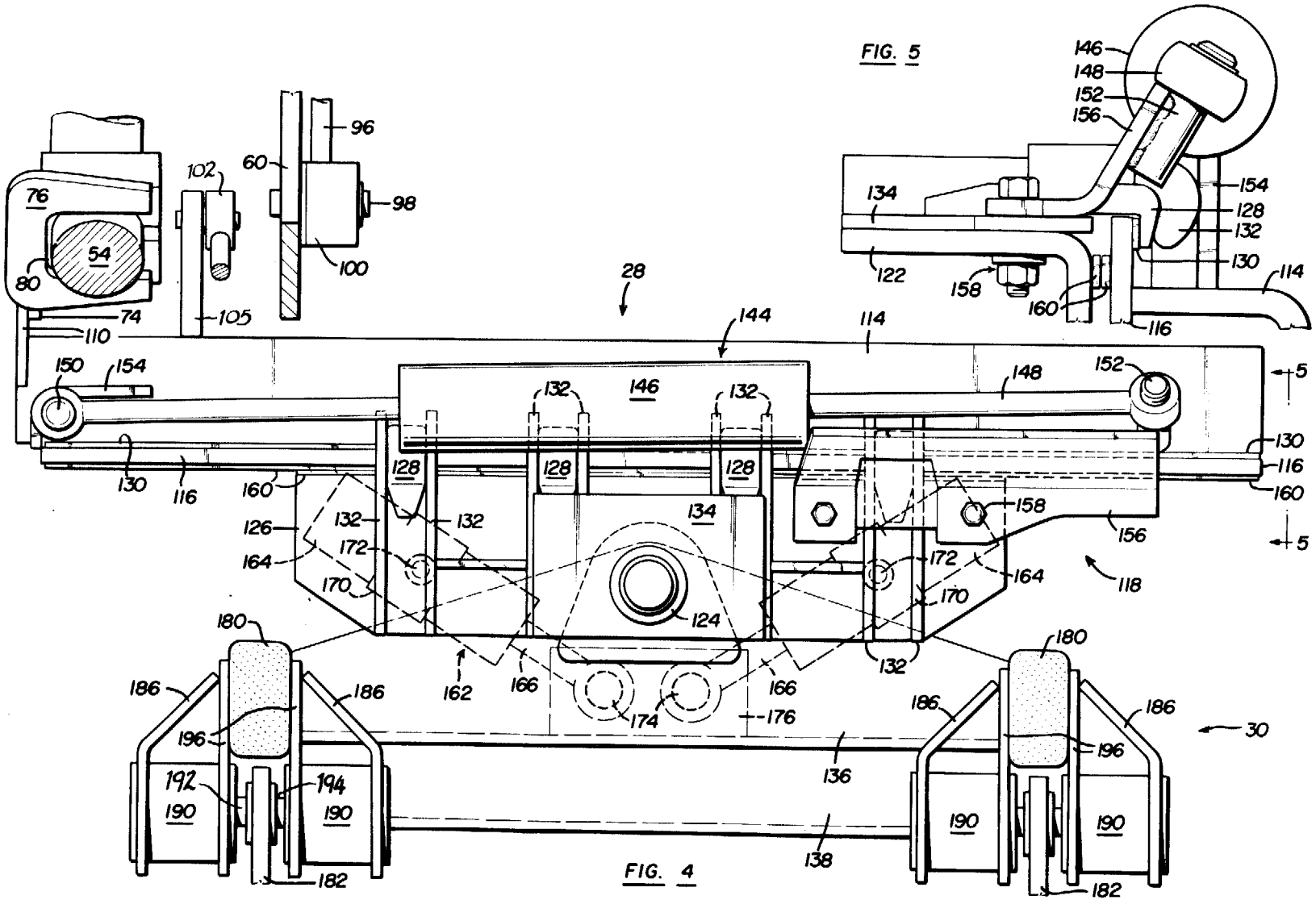
FIG. 4 is a partial top elevation of the side and angle adjustment mechanism disclosed in FIGS. 1 and 2.
FIG. 5 is a partial side view of FIG. 4 in the direction of view arrows 5—5.

The slide frame 52 includes opposed end plates 74, top and bottom collar plates 76 and 78, respectively, having suitable bearings 80 as shown in FIG. 4 and top and bottom box supports 82 and 84, as shown in FIG. 3. The box supports in the disclosed embodiments are bolted by suitable bolts 86 to the end plates 74 and the collar plates 76 and 78 may be weleded to the box supports. welded The tilting, raising and lowering of the mast assembly is accomplished in the disclosed embodiment remotely controlled double-acting hyraic cylinders or pistons. It will be understood, however, that various power means may be utilized. For example, the slide frame 52 may be raised and lowered by a rack and pinion assembly, however, the preferred embodiment includes hydraulic cylinders because of the ease of control and durability of pistons in field applications. In the disclosed embodiments, the tilt adjustment is accomplished by hydraulic pistons 90 which are pivotally mounted on the prime mover pin 92 on boss 94, as shown in FIG. 2. The extensible piston rods 96 are pivotally secured to the support frame as shown in FIGS. 3 and 4. A pin 98 extends through the upright or vertical plates 60 and clamp plates 100 are provided between the piston rod and the vertical plates. Extension and retraction of pistons 90 thereby adjusts the tilt angle of the mast assembly 26 and thereby the tilt angle of the plow blade, as further described hereinbelow.

The support frame is similarly raised and lowered by double- acting hydraulic pistons 102, which are supported on plates 104 welded to top plate 56. The opposed end of piston 102 are pivotally connected to plates 105 of slidable frame member 42. The slide frame member 52 thus be raised and lowered by retraction and extension of clyinders 102. As described hereinbelow, raising and lowering of slide frame 52 also raises and lowers the plow blade 32.

As described above, the angular and lateral adjustment of blade 32 is accomplished by control mechanism 28. This control is best shown in FIGS. 2,4 and 5. The control mechanism is supported on the end plates 74 of slide frame 52. Vertical support plates 110 are bolted by bolts 112 to end plates 74 as shown in FIG. 2. The support plates 110 are welded to support channel 114, which structure supports the control mechanism 28 and the tractor plow assembly. The top and bottom edgs of vertical plate 116, which is welded to channel 114, form horizontal rails for laterial shifting of the blade assembly. Plates 110 and 116 and channel 114 are referred to herein as the relatively fixed frame assembly and 118 refers to the slide frame assembly.

The slide frame assembly includes a main support channel 122 which is supported on a central cylindrical pivot 124. Plates 126 are bolted to the top and bottom of channel 122, for supporting hook-shaped elements 128 which are slidably received on the top and bottom edge of plate 116. In the disclosed embodiment, bearing strips 130 are disposed between the hook- shaped elements 128 and the plate 116. Plates 132 are welded to support plates 126, adding lateral strength to hook-shaped elements 128. End plates 134 are welded to the top surface of plates 132, providing a box-shaped support structure. Rearwardly extending channels 136 and 138 the blade frame assembly 30, as described hereinbelow.

In the disclosed embodiment, the blade assembly is shifted laterally by a fluid actuated piston 144 having a cylinder 146 and piston rod 148. One end is connected to pin 150 of the relatively fixed frame assembly and the opposed rod is connected to pin 152 of the slide frame assembly. Support plate or standard 154 retains the rod 150 to channel 114 of the fixed frame assembly and bracket 156 retains the pin 152 to the slide frame assembly, as shown in FIG. 5. In the disclosed embodiment, the bracket is secured to the slide frame assembly by bolts 158 and bearing strips 160 provided between the support plate 116 and channel 122.

The blade assembly may be angularly adjusted about pivot 124 by actuation of hydraulic pistons 162 having cylinders 164 and piston rods 166 as shown in FIG. 4. Cylinders 164 are pivotally supported within the main channel 122 opposed by plates 168, which may be welded to the channel as shown in FIG. 2. The cylinders are received in collars 170 which are supported by pins 172 between the plates as shown in FIG. 4. The piston rods are pivotally connected by pins 174 to horizontal plate 176, which plate forms a part of the frame assembly 30 and which is pivotally supported on a vertical pivot 124 as shown in FIG. 4.

Actuation of the pistons 162, by extension of one piston rod and retraction of the opposed piston rod, will therefore result in rotation of the blade frame assembly 30 about vertical pivot 124, providing angle adjustment for the blade assembly.

Figure 6:
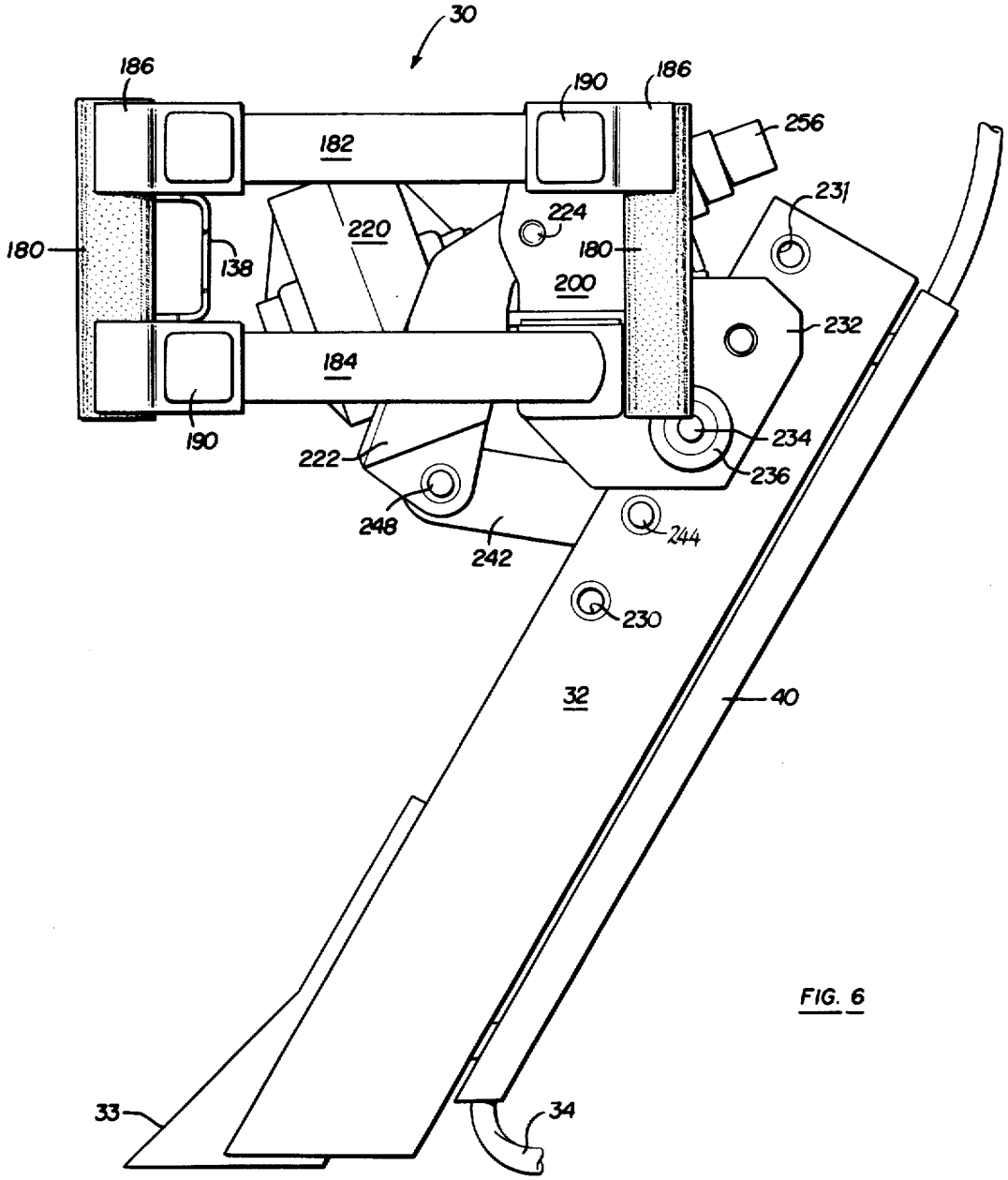
FIG. 6 is an enlarged side elevation of the plow blade and the supporting frame shown in FIG. 1.

The improved frame assembly 30 is shown in FIGS. 6 to 10. As shown in FIG. 6, the frame assembly is supported on channel 138. The frame assembly includes a parallelogram linkage having elastomeric support cushioning elements as described in the above reference U.S. Pat. 3,618,237, which is incorporated herein by reference.

Figure 7:
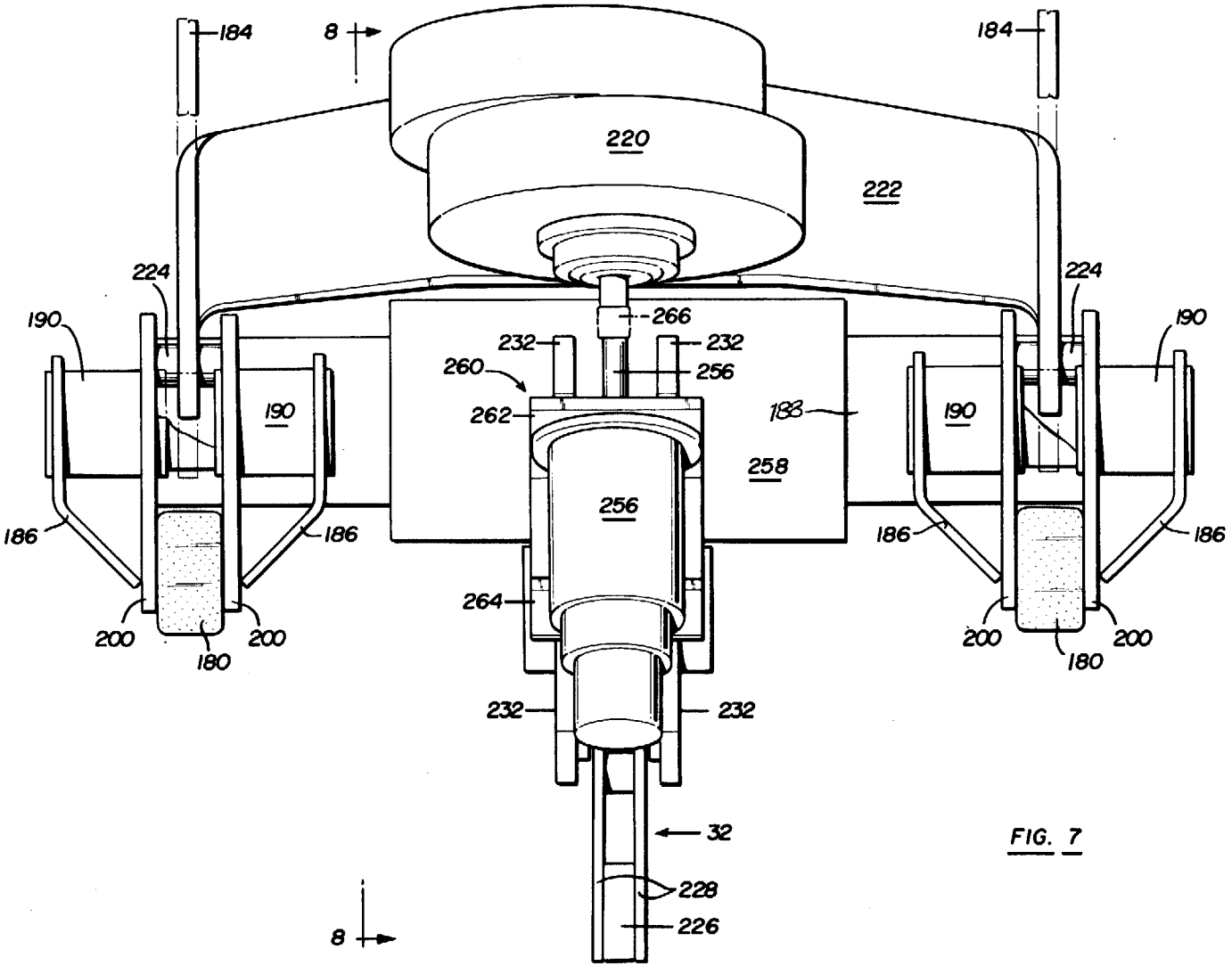
FIG. 7 is a partial top assembly of the blade and support frame shown in FIG. 6.
Figure 8:
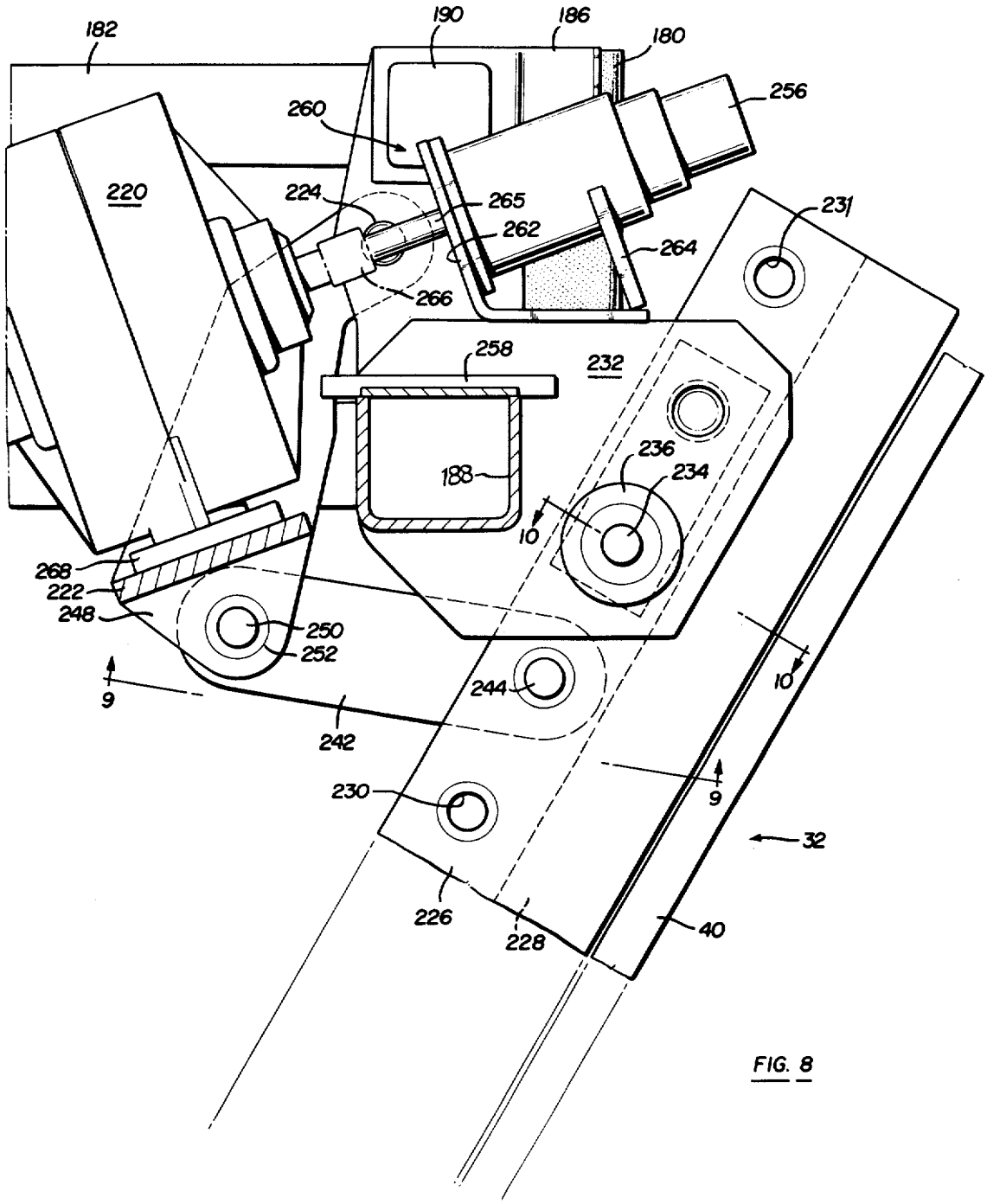
FIG. 8 is a cross-sectional side view of the plow blade and support frame shown in FIG. 7, in the direction of view arrows 8—8.

The parallelogram linkage include four vertical columns 180, upper side plates 182, lower side plates 184 and a support beam 188 shown in FIGS. 7 and 8. End plates 186 are secured to the side plates by elastomeric torque cushioning elements 190, which elements are rectangular as shown in FIG. 6. The side plates 182 are secured to vertical columns 180 adjacent control mechanism 128 by pins 192 having resilient bushings 194, as shown in FIG. 4. Opposed plates 196 may be welded to vertical columns 180, which plates are secured to torque cushioning elements 190, as shown FIG. 4 and described in the above-referenced referenced patent. Similarly, support plates 200 may be welded to the rearward vertical columns 180, which plates are supported on torque cushioning elements 190, as shown in FIG. 7. Other details of the parallelogram linkage of the blade support frame may be found in the above-referenced United States patent. This application, however, discloses a unique support for the vibrator and plow blade, which results in orbital or arcuate vibratory motion of the blade, as described hereinbelow.

The vibrator 220 in the preferred embodiment is mounted on a pivotally supported yoke 222. The yoke is supported on plates 200, which in turn are supported on vertical columns 180 as by welding the plates to the columns, as shown in FIG. 7. The opposed ends of the yoke are pivotally supported on pins 224 which may include resilient elastomeric bearing elements. The blade in the preferred embodiment is also pivotally supported frame 30, as best shown in FIGS. 8 and 10. The blade assembly 32 includes a vertical rigid blade 226, cover plates 228 and toe 33, as shown in FIGS. 6 and 10. The blade is pivotally supported on plates 232 by transverse pivot pin 234. Resilient elastomeric bearing elements 236 are received in plates 232. Alternatively, the bushing 238 between the plates 228 may include a resilient center bushing. The end plates 228 are welded to the blade 226. The yoke 222 is pivotally connected to the blade assembly by link 242, as shown in FIGS. 8 and 9. Link 242 is pivotally connected to the blade pin 244 which extend between cover plates 228. Integral lugs 248 are connected to the yoke 22, generally in the axis of the vibrator. The integral lugs are pivotally connected to link 242 by pin 250.

The vibrator 220 is therefore supported on a four-bar linkage, including link 242, yoke22, the frame assembly and the blade 32. Vibrations are thus transmitted from the yoke 22, through link 242, to the blade, and the blade isresiliently and pivotally supported on plate 232. The resilient elastomeric bearing 236 permits limited longitudinal movement of the blade and pivotal movement about pin 234, resulting in arcuate or orbital motion of the blade in the ground. This motion may be modified for soil condtions by moving the pivotal connection of the link to the blade. In the disclosed embodiment, pivot pin 244 may be moved to the lower blade aperture 230. The blade may also be shifted downwardly for deep soil penetration, using blade aperture 231.

The vibrator or shaker 220 is driven by a suitable mtor 256 which is mounted on bracket 260. The bracekt may be welded or otherwise secured to plates 232, which plate is welded or otherwise secured on plate 258 and beam 188. The disclosed bracket includes support plates 262 and 264 and the shaft 265 of the motor is connected through universal coupling 266 to the shaker or vibrator. The vibrator 220 may be secured by any suitable means to the yoke 222. In the disclosed 220 may be secured by any suitable plate 268 is provided which is mounted to the yoke.

The disclosed vibrator or shaker 220 is a conventional doubleweight vibraotr eccentric weights mounted on a central shaft. The weights are timed to produce vibrations in any preferred axis or plane. The vibrator will normally be timed to produce vibrations perpendicular to the plane of the plate 268, producing the desired orbital motion in the blade 32. One suitable vibrator is sold commerically by Ajax Flexible Coupling Co., of Westfield, N.Y., and disclosed in U.S. Pat. Nos. 1,999,213, 2,097,347 and 2,178,813 . The motor may be conventional hydrostatic fixed displacement motor from various sources. As disclosed, the general assembly of the various frame elements is composed of a plurality of plates, channels and the like, which may be formed of suitable material, including conventional structure steel.

The operation of disclosed vibratory cable-laying plow may be fully understood from the above description of the various figures, however, the following is a brief description of the overall operation. First, the blade assembly 32 may be raised, lowered and tilted by operation of the mast assembly 26, best shown in FIGS. 2 and 3. As will be understood from the description above, the support frame 50 is pivotally supported on plate 66 of the prime mover or vehicle 22. The slide frame assembly 42 is slidable supported on rails 54 which are part of the support frame assembly. The blade assembly 32 is supported on the slide frame assembly as best shown in FIG. 1. Actuation of pistons 102 raises and lowers the slide frame assembly 52 and therefore the blade assembly 32. Actuation of pistons 90 adjust the tilt angle of the mast assembly 26 relative to true vertical, thereby asjusting the tilt angle of the blade assembly. The piston rod 96 of piston 90 may be extended to increase the downward thrust at the rear of the plow blade; foward tilting, resulting from retraction of the piston rod, provides additional lift height of the blade and additional clearance during transport of the vibratory plow. Rearward tilt of the mast assembly also causes the blade to travel slightly to rearward if the plow is raised through use of the vertical lift mechanism. This action is advantageous in that there is less tendency for additional cable to be drawn through the chute or guide 40 as the plow blade is raised, thereby reducing cable damage. Similarly, reverse bending of the cable may be held to a minumum by adjusting the tilt angle of the blade. Foward tilt of the vertical mast may also be used when lowering the plow blade into the ground to protect the cable chute from damage, whereby the chute is tilted away from the ground during entry of the blade. Further, the attack angle of the blade may be varied to compensate for varying soil conditions. And, the depth of the cut of the blade may be varied by lift cylinders 102, without requiring respositioning of the blade with respect to the plow support assembly.

The blade may be caused to track laterally by operation of control mechanism 28. As described, a cable-laying plow is normally rigidly mounted in the longitudinal axis of the prime mover or vehicle 22, however it may be most desirable to move the plow laterally, at times during operation of the cable-laying plow. The disclosed embodiment permits remote operation and control of the lateral position of the blade. The blade may be turned by actuation of pistons 162, best shown in FIGS. 2 and 4.

Extension of one piston rod 166 and retraction of the other causes the frame assembly 30 to pivot about vertical pivot 124, turning the blade 32 relative to the longitudinal axis of the prime mover. The blade may thereby be caused to track the prime mover or follow a separate path by simultaneous action of cylinder 144. As described above, slide frame assembly 118 is slidably supportd on plate 116, which plate forms part of the relatively fixed frame assembly supported on the mast assembly 26. Actuation of piston 144 results in lateral motion of slide frame assembly 118 and therefore blade 32. The blade may be shifted laterally, relative to the longitudinal axis of the prime mover 22, prior to entry of the blade in the soil or the blade may be caused to track laterally by simulataneous operation of pistons 162 and 144 while the plow is in the soil and during the continuous operation.

As described above, the unique suspension of the blade 32 and vibrator 220 results in an orbital or arcuate motion of the blade toe 33, as shown in FIGS. 6 to 10. The vibrator 220 is suspended on a U-shaped yoke 222 which is pivotally supported on the blade support assembly 30. The blade 32 is pivotally and resilently supported on the frame assembly and the yoke 22 is pivotally supported to the blade by link 242. This four-bar assembly results in orbital motion of the blade upon actuation of the vibrator or shaker 222.

It will be understood that various modifications may be made to the disclosed vibrator cable-laying plow, particularly in regard to the structural details which have been described herein by way of example. The unique cable-laying plow assembly may be used to remotely tilt, angle, laterally shift, raise and lower the blade assembly and results in an improved orbital motion of the blade. Various modifications of the disclosed assembly may therefore be made to achieve these various purposes and the systems may be utilized independently for the advantages stated.

We claim:

1. A cable laying plow for laying cable, pipe and the like underground comprising:

a vehicle, a mast assembly including a support frame pivotally connected to said vehicle, a pair of laterally spaced generally vertical rails supported on said frame assembly including a top end plate interconnecting said rails and a slide frame slideably mounted on said rails including two opposed frame members each slideably mounted on one of said rail, a generally vertical plow blade operably supported on said slide frame including a cable guide means for feeding cable, pipe and the like into the cut made by said blade, a fluid operated piston having an extensible piston rod interconnected between said support and slide frames adapted to raise and lower said slide frame and blade relative to said vehicle and an extensible fluid piston means pivotally connected to said vehicle and to said support frame spaced from the pivotal connection to said vehicle, said piston means adapted to adjust the tilt angle of said mast assembly relative to said vehicle and thereby the angle of said plow blade.

2. The cable laying plow defined in claim 1, characterized in that said rails are cylindrical and interconnected by opposed end plates of said support frame assembly and said slide frame comprises opposed framed members having cylindrical bearing surfaces slideably mounted on said rails.

3. A frame support for a vertical plow blade on a vehicle, said frame support including a vertical mast pivotally supported on the vehicle and a slide slideably supporting said plow blade on said mast for raising and lowering the plow blade, comprising:

said mast having two laterally spaced generally vertical rails interconnected by a mast frame, said slide including two opposed slide members each slideably supported on one of said rails interconnected by a slie frame, said blades supported on said slide frame and an extensible fluid piston interconnecting said slide and mast frames for raising and lowering said plow blade.

4. The frame support defined in claim 3, wherein each of said opposed slide members are pivotally supported on said vehicle and said slide members are each supported on said mast frame by a fluid piston.

5. The frame support defined in claim 3, wherein said vertical rails are generally cylindrical and said opposed slide members each include cylindrical bearing surfaces receiving said cylindrical rails and slideably supporting said side frame.

* * * * *